US006810992B1

(12) United States Patent
Lombardo

(10) Patent No.: US 6,810,992 B1
(45) Date of Patent: Nov. 2, 2004

(54) SOUND PRODUCING VEHICLE EXHAUST SYSTEM

(76) Inventor: Mario Lombardo, 270 - 115th Ave., Treasure Island, FL (US) 33706

( * ) Notice: Subject to any disclaimer, the term of this patent is extended or adjusted under 35 U.S.C. 154(b) by 21 days.

(21) Appl. No.: 10/246,951

(22) Filed: Sep. 19, 2002

(51) Int. Cl.[7] ..... F01N 7/08; F01N 1/16; G10K 5/00

(52) U.S. Cl. ..... 181/227; 181/228; 181/217; 181/277; 116/138

(58) Field of Search ..... 181/227, 228, 181/225, 217, 277, 271; 116/138; D10/119, 120; 446/204

(56) References Cited

U.S. PATENT DOCUMENTS 867,973 A * 10/1907 Hoover ..... 181/277
896,606 A * 8/1908 Wright ..... 116/138
1,019,571 A * 3/1912 West ..... 116/138
1,276,935 A * 8/1918 Leary ..... 181/277
1,473,235 A * 11/1923 El Dorado Jones ..... 181/277
1,885,062 A * 10/1932 Nicolich ..... 181/277
2,076,827 A * 4/1937 Ross ..... 181/277
2,679,230 A * 5/1954 Ward ..... 116/138
3,000,465 A * 9/1961 Bruno ..... 181/277
3,558,084 A * 1/1971 Cotton ..... 244/63
4,385,585 A * 5/1983 Lebowitz ..... 116/67 R
4,694,653 A * 9/1987 Kawamura ..... 60/597
4,694,654 A * 9/1987 Kawamura ..... 60/597
4,813,368 A * 3/1989 Hutter et al. ..... 116/67 R
4,886,978 A * 12/1989 Kawamura ..... 290/52
4,966,253 A * 10/1990 Stephens et al. ..... 181/227
5,334,071 A * 8/1994 Mills ..... 446/186
6,006,859 A * 12/1999 Hussaini ..... 181/227
6,343,673 B1 * 2/2002 Chang ..... 181/227
6,367,580 B1 * 4/2002 Chang ..... 181/241

* cited by examiner

*Primary Examiner*—David Martin
*Assistant Examiner*—Edgardo San Martin
(74) *Attorney, Agent, or Firm*—Edward P. Dutkiewicz

(57) ABSTRACT

A sound producing vehicle exhaust system comprises a housing positionable over an exterior end of a vehicle tailpipe. A turbine has at least one support plate. The support plate is rotatable about a central axis of rotation with the housing and has a plurality of angular blades with interior ends coupled to the support plate for rotation there with. At least one facing disk is positioned within the housing adjacent to the turbine. A central axis is provided through the facing disk and support plate. At least one bearing pin is provided. The bearing pin rotatably couples the support plate to the facing disk. A plurality of apertures extend through the facing disk. In this manner exhaust gasses from a tailpipe will pass through the blades and create a turbine-like sound.

3 Claims, 4 Drawing Sheets

FIG 5
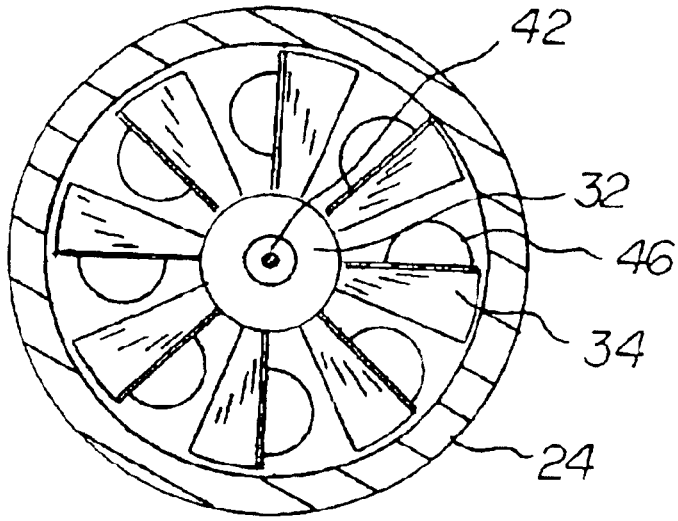
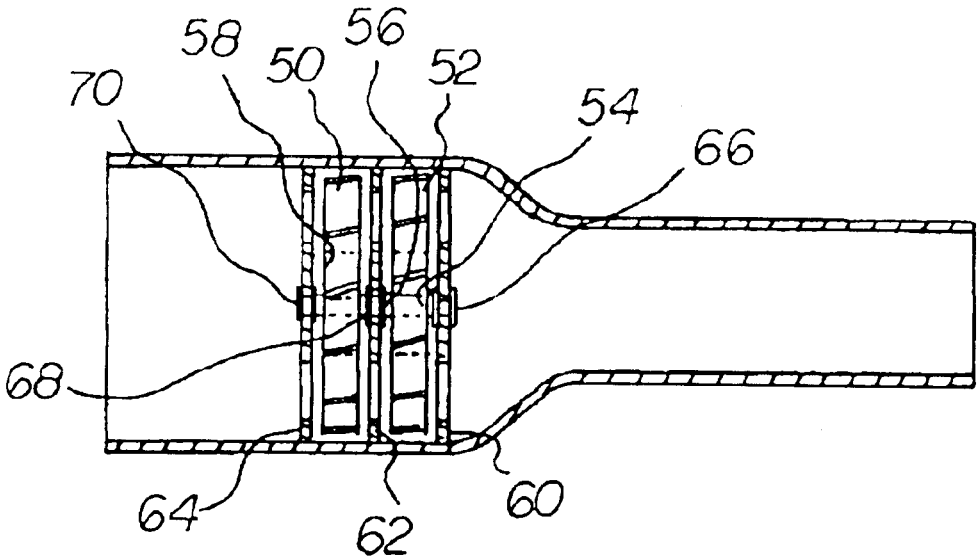
FIG 6

SOUND PRODUCING VEHICLE EXHAUST SYSTEM

BACKGROUND OF THE INVENTION

1. Field of the Invention

The present invention relates to a sound producing vehicle exhaust system and more particularly pertains to creating a turbine-like sound by the exhaust fumes of a vehicle tailpipe.

2. Description of the Prior Art

The use of sound producers of known designs and configurations is known in the prior art. More specifically, sound producers of known designs and configurations previously devised and utilized for the purpose of creating sounds through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,334,071 issue to Mills discloses a steam locomotive-whistle model and toy. U.S. Pat. No. 4,886,978 issue to Kawamura discloses an exhaust energy recovery apparatus for an engine. U.S. Pat. No. 4,813,368 issue to Hutter III et al. discloses musical tea kettle. U.S. Pat. No. 4,694,654 issue to Kawamura discloses ab exhaust energy recovery and generator for use with an engine. U.S. Pat. No. 4,966,253 issue to Stephens et al. discloses a muffler device for exhaust systems. U.S. Pat. No. 4,694,653 issue to Kawamura discloses an engine energy recovery apparatus. U.S. Pat. No. 4,385,585 issue to Lebowitz discloses a teakettle having whistle cap. Lastly, U.S. Pat. No. 3,558,084 issue to Cotton discloses a gas turbine.

While these devices fulfill their respective, particular objectives and requirements, the aforementioned patents do not describe a sound producing vehicle exhaust system that allows creating a turbine-like sound by the exhaust fumes of a vehicle tailpipe.

In this respect, the sound producing vehicle exhaust system according to the present invention substantially departs from the conventional concepts and designs of the prior art, and in doing so provides an apparatus primarily developed for the purpose of creating a turbine-like sound by the exhaust fumes of a vehicle tailpipe.

Therefore, it can be appreciated that there exists a continuing need for a new and improved sound producing vehicle exhaust system which can be used for creating a turbine-like sound by the exhaust fumes of a vehicle tailpipe. In this regard, the present invention substantially fulfills this need.

SUMMARY OF THE INVENTION

In view of the foregoing disadvantages inherent in the known types of sound producers of known designs and configurations now present in the prior art, the present invention provides an improved sound producing vehicle exhaust system. As such, the general purpose of the present invention, which will be described subsequently in greater detail, is to provide a new and improved sound producing vehicle exhaust system and method which has all the advantages of the prior art and none of the disadvantages.

To attain this, the present invention essentially comprises a vehicle. The vehicle has an internal combustion engine. The internal combustion engine has a tailpipe. The tail pipe has a cylindrical exterior end for the exhausting of spent gasses under pressure. A housing is provided. The housing has an interior cylindrical portion of a first diameter. The housing is removably positioned over the cylindrical exterior end of the tailpipe. The housing has an exterior cylindrical end. The exterior cylindrical end extending rearwardly and is of a second diameter greater than the first diameter. A frusto-conical intermediate portion is provided there between. A turbine is provided next. The turbine has spaced circular support plates. The circular support plates are concurrently rotatable about a central axis of rotation coaxial with the housing and with a plurality of angular blades. The angular blades have interior ends. The interior ends are coupled to the support plates for rotation between the support plates. The blades have exterior ends. The exterior ends are spaced a distance less than the diameter of the interior end of the housing. Further provided are spaced circular facing disks. The disks include an interior facing plate and a parallel exterior facing plate. The exterior facing plate is positioned within the exterior portion of the housing adjacent to the intermediate portion. The exterior plated are located on opposite sides of the turbine. A central axis is provided through the facing disks and support plates. Bearing pins are rotatably coupling the support plates to the facing disks. In this manner the blades and support plates are allowed to rotate about the axis with respect to the facing disks and housing. Provided last is a plurality of circular apertures. The apertures extend through the facing disks. The apertures extend in a circular pattern. The circular apertures of the facing disks are in axial alignment. The circular apertures are on opposite sides of the blades. Exhaust gasses from the tailpipe will pass through the interior portion of the housing. Exhaust gasses will pass through the intermediate portion of the housing. Exhaust gasses will then pass through the interior facing disk and the blades and the exterior facing disk. Finally, exhaust gasses will pass out of the exterior portion of the housing to rotate the blades. In this manner a turbine-like sound is created.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sound producing vehicle exhaust system which has all of the advantages of the prior art sound producers of known designs and configurations and none of the disadvantages.

It is another object of the present invention to provide a new and improved sound producing vehicle exhaust system which may be easily and efficiently manufactured and marketed.

It is further an object of the present invention to provide a new and improved sound producing vehicle exhaust system which is of durable and reliable constructions.

An even further object of the present invention is to provide a new and improved sound producing vehicle exhaust system which is susceptible of a low cost of manufacture with regard to both materials and labor, and which accordingly is then susceptible of low prices of sale to the consuming public, thereby making such sound producing vehicle exhaust system economically available to the buying public.

Even still another object of the present invention is to provide a sound producing vehicle exhaust system for creating a turbine-like sound by the exhaust fumes of a vehicle tailpipe.

Lastly, it is an object of the present invention to provide a new and improved sound producing vehicle exhaust system comprising a housing positionable over the exterior end of a vehicle tailpipe. A turbine has at least one support plate. The support plate is rotatable about a central axis of rotation with the housing and has a plurality of angular blades with interior ends coupled to the support plate for rotation there with. At least one facing disk is provided. The facing disk is positioned within the housing adjacent to the turbine. A central axis is provided through the facing disk and support plate. At least one bearing pin is provided. The bearing pin rotatably couples the support plate to the facing disk. Provided last is a plurality of apertures. The apertures extend through the facing disk. In this manner exhaust gasses from a tailpipe will pass through the blades and create a turbine-like sound.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross-sectional view taken along line 5—5 of FIG. 4.

FIG. 6 is a cross-sectional view similar to FIG. 4 but showing an alternate embodiment of the invention.

The same reference numerals refer to the same parts throughout the various Figures.

DESCRIPTION OF THE PREFERRED EMBODIMENT

Figure 1:
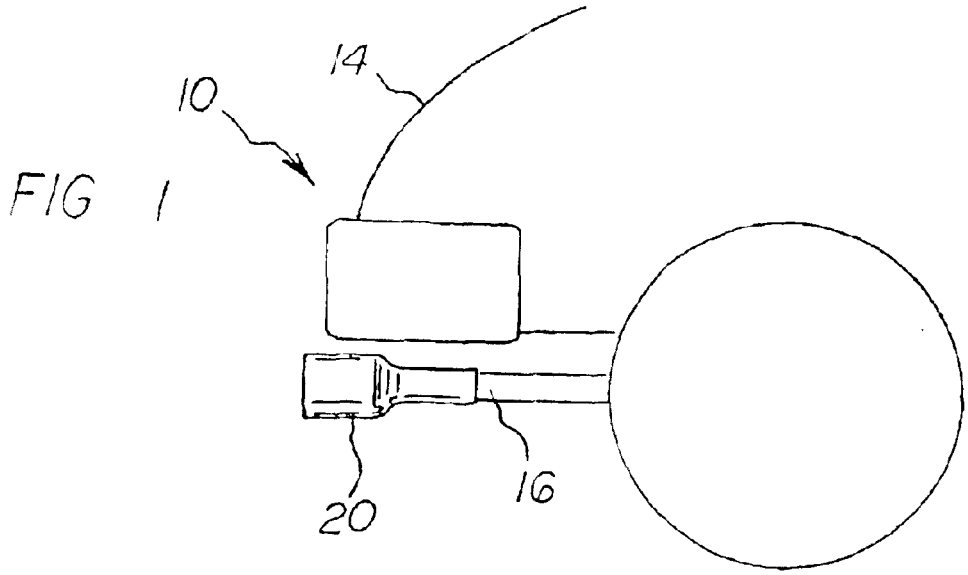
FIG. 1 is a side elevational view of the sound producing vehicle exhaust system constructed in accordance with the principals of the present invention.
Figure 2:
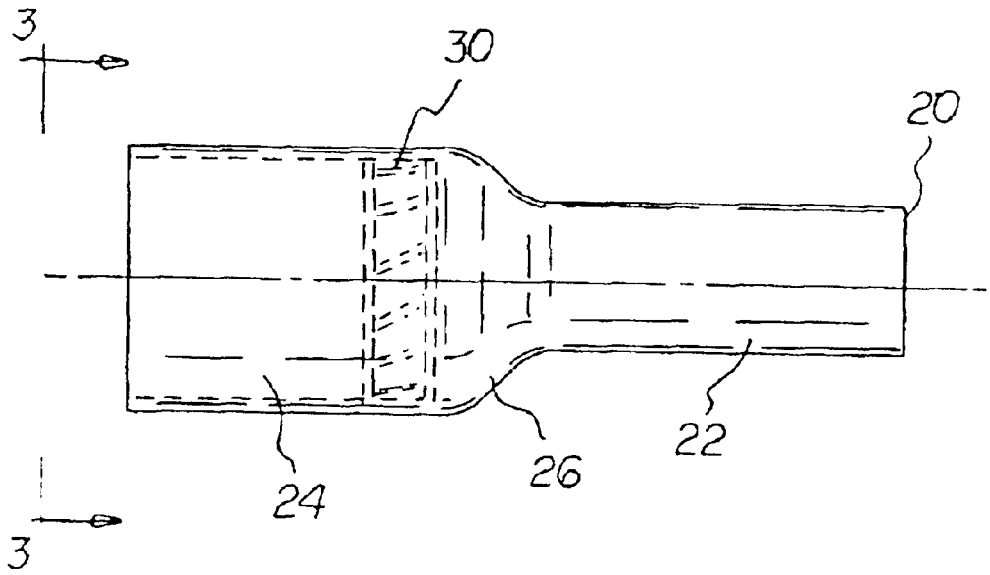
FIG. 2 is an enlarged side elevational view of the housing shown in FIG. 1.
Figure 3:
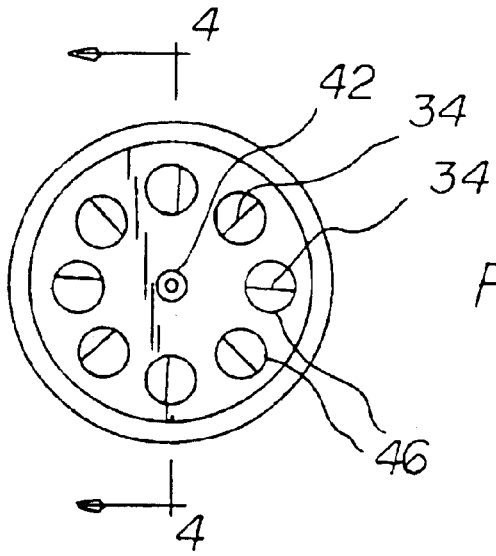
FIG. 3 is an end elevational view taken along line 3—3 of FIG. 2.
Figure 4:
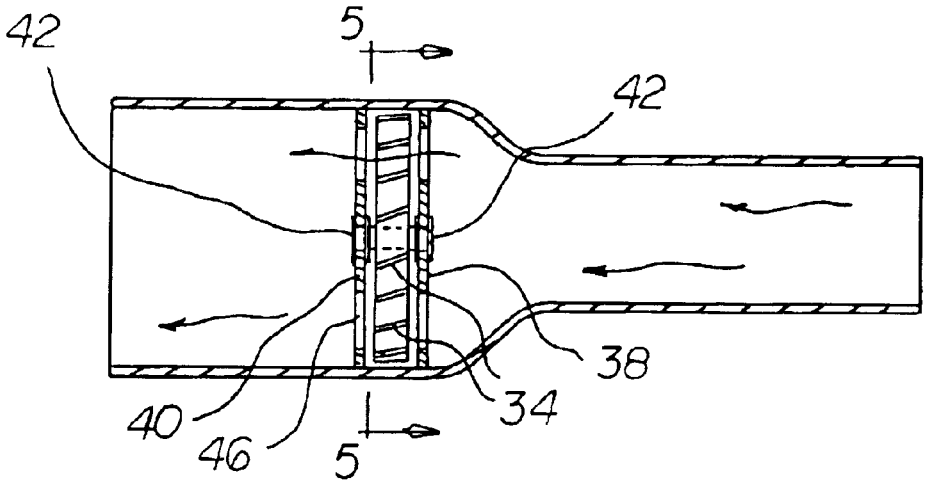
FIG. 4 is a cross-sectional view taken along line 4—4 of FIG. 3.

With reference now to the drawings, and in particular to FIG. 1 thereof, the preferred embodiment of the new and improved sound producing vehicle exhaust system embodying the principles and concepts of the present invention and generally designated by the reference numeral 10 will be described.

The present invention, the sound producing vehicle exhaust system 10 is comprised of a plurality of components. Such components in their broadest context include a cylindrical housing, a turbine, at least one facing disk and a plurality of circular apertures. Such components are individually configured and correlated with respect to each other so as to attain the desired objective.

First provided is a vehicle 14. The vehicle has an internal combustion engine. The internal combustion engine has a tailpipe. The tail pipe has a cylindrical exterior end 16 for the exhausting of spent gasses under pressure.

A housing 20 is provided. The housing has an interior cylindrical portion 22 of a first diameter. The housing is removably positioned over the cylindrical exterior end of the tailpipe. The housing has an exterior cylindrical end 24. The exterior cylindrical end extending rearwardly and is of a second diameter greater than the first diameter. A frusto-conical intermediate portion 26 is provided there between.

A turbine 30 is provided next. The turbine has spaced circular support plates 32. The circular support plates are concurrently rotatable about a central axis of rotation coaxial with the housing and with a plurality of angular blades 34. The angular blades have interior ends. The interior ends are coupled to the support plates for rotation with the support plates. The blades have exterior ends. The exterior ends are spaced a distance less than the diameter of the exterior end of the housing.

Further provided are spaced circular facing disks. The disks include an interior facing plate 38 and a parallel exterior facing plate 40. The exterior facing plate is positioned within the exterior portion of the housing adjacent to the intermediate portion. The exterior plate is located on opposite sides of the turbine. A central axis is provided through the facing disks and support plates. Bearing pins 42 are rotatably coupling the support plates to the facing disks. In this manner the blades and support plates are allowed to rotate about the axis with respect to the facing disks and housing.

Provided last is a plurality of circular apertures 46. The apertures extend through the facing disks. The apertures extend in a circular pattern. The circular apertures of the facing disks are in axial alignment. The circular apertures are on opposite sides of the blades. Exhaust gasses from the tailpipe will pass through the interior portion of the housing. Exhaust gasses will pass through the intermediate portion of the housing. Exhaust gasses will then pass through the interior facing disk and the blades and the exterior facing disk. Finally, exhaust gasses will pass out of the exterior portion of the housing to rotate the blades. In this manner a turbine-like sound is created.

Figure 7:
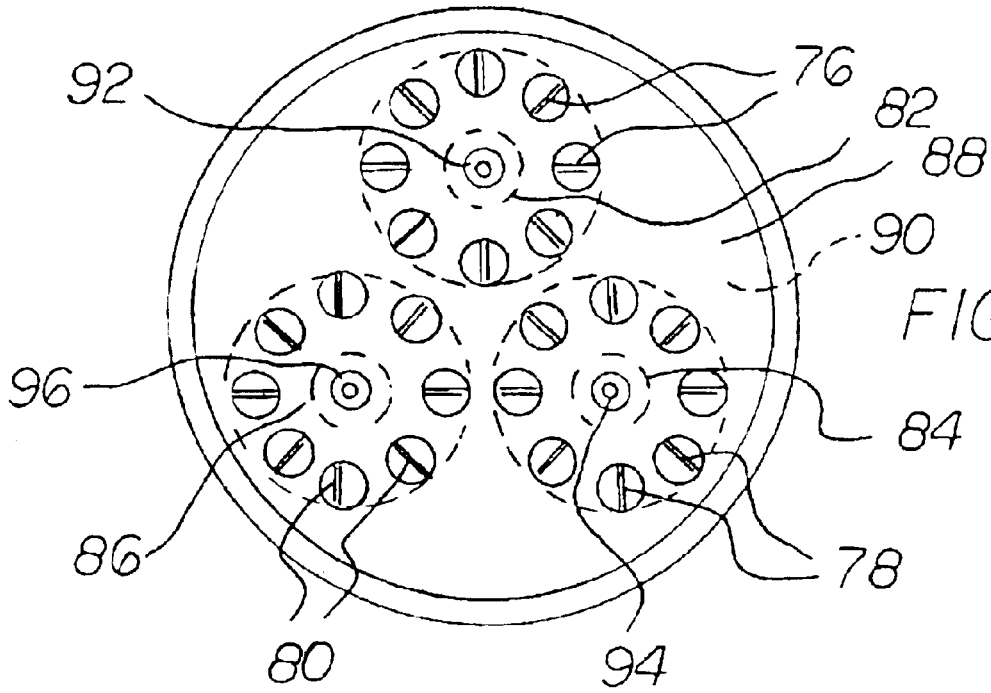
FIG. 7 is an end elevational view similar to FIG. 3 but showing another alternate embodiment of the invention.

Alternate embodiments of the invention are shown in FIGS. 6 and 7. In the FIG. 6 embodiment, two set of blades 50, 52 are provided. Each set of blades is supported by an associated support plate 54, 56, 58. Each set of blades, with its associated support plate, is located between adjacent apertured facing plates 60, 62, 64 and rotatably supported by the facing plates by pins 66, 68, 70.

In the FIG. 7 embodiment, a plurality of sets of blades 76, 78, 80 are provided. Each set of blades is supported by an associated support plate 82, 84, 86. The sets of blades, with its support plate, are located between a pair of apertured facing plates 88, 90 and rotatably supported by the facing plates by pins 92, 94, 96.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sound producing vehicle exhaust system for creating a turbine-like sound by the exhaust fumes of a vehicle tailpipe comprising, in combination:

a vehicle with an internal combustion engine having a tailpipe with a cylindrical exterior end for the exhausting of spent gasses under pressure;

a housing having an interior cylindrical portion of a first diameter removably positioned over the cylindrical exterior end of the tailpipe and having an exterior cylindrical end extending rearwardly and of a second diameter greater than the first diameter and having a frusto-conical intermediate portion there between;

two turbines, each spaced circular support plates rotatable about a common central axis of rotation coaxial with the housing and with a plurality of angular blades with interior ends coupled to the support plates for rotation there with, the blades having exterior ends spaced a distance less than the diameter of the exterior end of the housing;

three spaced circular facing disks including an interior facing plate and a parallel exterior facing plate and one parallel intermediate facing plate positioned within the exterior portion of the housing adjacent to the intermediate portion and located on opposite sides of the turbines with a central axis through the facing disks and support plates and with bearing pins rotatably coupling the support plates to the facing disks to allow the blades and support plates to rotate about the axis with respect to the facing disks and housing; and a plurality of circular apertures extending through the facing disks in a circular pattern with the circular apertures of the facing disks in axial alignment and on opposite sides of the blades whereby exhaust gasses from the tailpipe will pass through the interior portion of the housing and then through the intermediate portion of the housing and then through the interior facing disk and the blades and the exterior facing disk and then out of the exterior portion of the housing to rotate the blades and thereby create a turbine-like sound.

2. A sound producing vehicle exhaust system comprising:

a cylindrical housing positionable over an exterior end of a vehicle tailpipe;

a turbine with parallel facing support plates rotatable about a central axis of rotation coaxial with the housing and with a plurality of angular blades with radially interior ends coupled to the support plates for rotation there with;

a pair of fixedly positioned associated facing disks parallel with the support plates positioned within the housing adjacent to the turbine with a central axis through the facing disks and support plates and with at least one bearing pin rotatably coupling the support plates to the facing disks, the axial length of the rotatable support plats and turbine being a first distance, the axial length between each rotatable support plate and its adjacent fixed facing disk being a second distance, the first distance being greater than the second distance; and a plurality of circular apertures, all of a common diameter, extending through each facing disk, the apertures of each disk being axially aligned with the apertures of each associated disk whereby exhaust gasses from a tailpipe will pass through the blades and thereby create a turbine-like sound.

3. A sound producing vehicle exhaust system for creating a turbine-like sound by the exhaust fumes of a vehicle tailpipe comprising, in combination:

a vehicle with an internal combustion engine having a tailpipe with a cylindrical exterior end for the exhausting of spent gasses under pressure;

a housing having an interior cylindrical portion of a first diameter removably positioned over the cylindrical exterior end of the tailpipe and having an exterior cylindrical end extending rearwardly and of a second diameter greater than the first diameter and having a frusto-conical intermediate portion there between;

a plurality of turbines, each with spaced circular support plates rotatable about a plurality of parallel axes of rotation coaxial with the housing and with a plurality of angular blades with interior ends coupled to the support plates for rotation there with, the blades having exterior ends spaced a distance less than the diameter of the exterior end of the housing;

spaced circular facing disks including an interior facing plate and a parallel exterior facing plate positioned within the exterior portion of the housing adjacent to the intermediate portion and located on opposite sides of the turbines with a central axis through the facing disks and with bearing pins rotatably coupling the support plates to the facing disks to allow the blades and support plates to rotate about the axis with respect to the facing disks and housing; and a plurality of circular apertures extending through the facing disks in a circular pattern with the circular apertures of the facing disks in axial alignment and on opposite sides of the blades whereby exhaust gasses from the tailpipe will pass through the interior portion of the housing and then through the intermediate portion of the housing and then through the interior facing disk and the blades and the exterior facing disk and then out of the exterior portion of the housing to rotate the blades and thereby create a turbine-like sound.

* * * * *